United States Patent [19]

Daugirdas et al.

[11] 4,134,231

[45] Jan. 16, 1979

[54] MODULATED OUTPUT FORCE DOOR OPERATOR

[75] Inventors: Kristupas Daugirdas, Wilmette; Samir Elguindy, Bensenville, both of Ill.

[73] Assignee: Vapor Corporation, Chicago, Ill.

[21] Appl. No.: 794,842

[22] Filed: May 9, 1977

[51] Int. Cl.[2] ..... E05F 15/06

[52] U.S. Cl. ..... 49/139; 49/26; 49/363

[58] Field of Search ..... 49/363, 360, 30, 39, 49/26, 28

[56] References Cited

U.S. PATENT DOCUMENTS

| | | | |
|---|---|---|---|
| 965,770 | 7/1910 | Voigt | 49/363 |
| 3,003,317 | 10/1961 | Schroeder et al. | 49/26 X |
| 3,453,778 | 7/1969 | Daugirdas | 49/363 X |
| 3,552,061 | 1/1971 | Hermann | 49/363 X |
| 3,916,567 | 11/1975 | Daugirdas | 49/28 |
| 3,938,282 | 2/1976 | Goyal | 49/360 X |

*Primary Examiner*—Kenneth Downey
*Attorney, Agent, or Firm*—Francis J. Lidd

[57] ABSTRACT

A pneumatic powered door operator including a pneumatic differential engine with an output shaft having a slide bar applying driving action through a roller to a multiplying lever wherein the multiplying lever is pivotally mounted at one end and provided with a roller at the other end and linkage means for interconnecting the multiplying lever to a slidable door. An electropneumatic control circuit controls the operation of the engine and includes a pneumatic spring arrangement which allows manual operation of the door during electrical failure with air available while being capable of maintaining the door in a closed position when not manually actuated.

13 Claims, 10 Drawing Figures

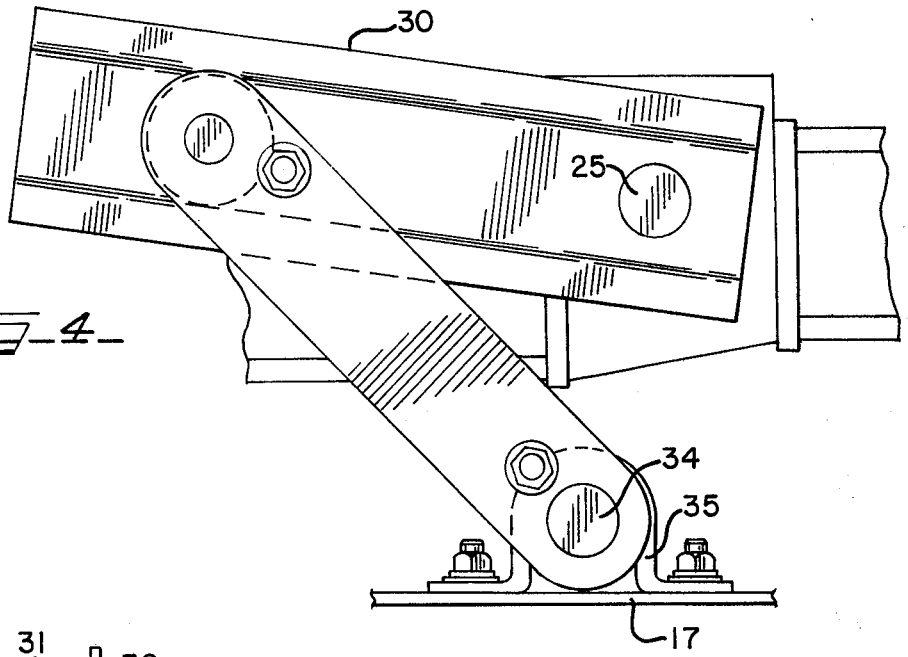
FIG. 4
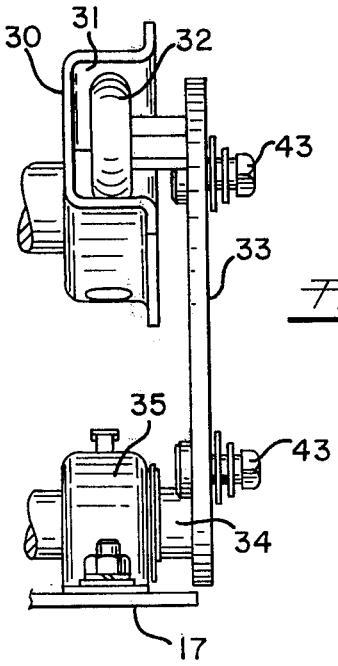
FIG. 5
FIG. 6
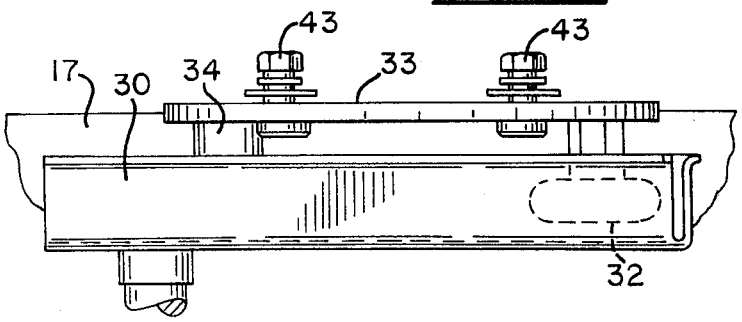

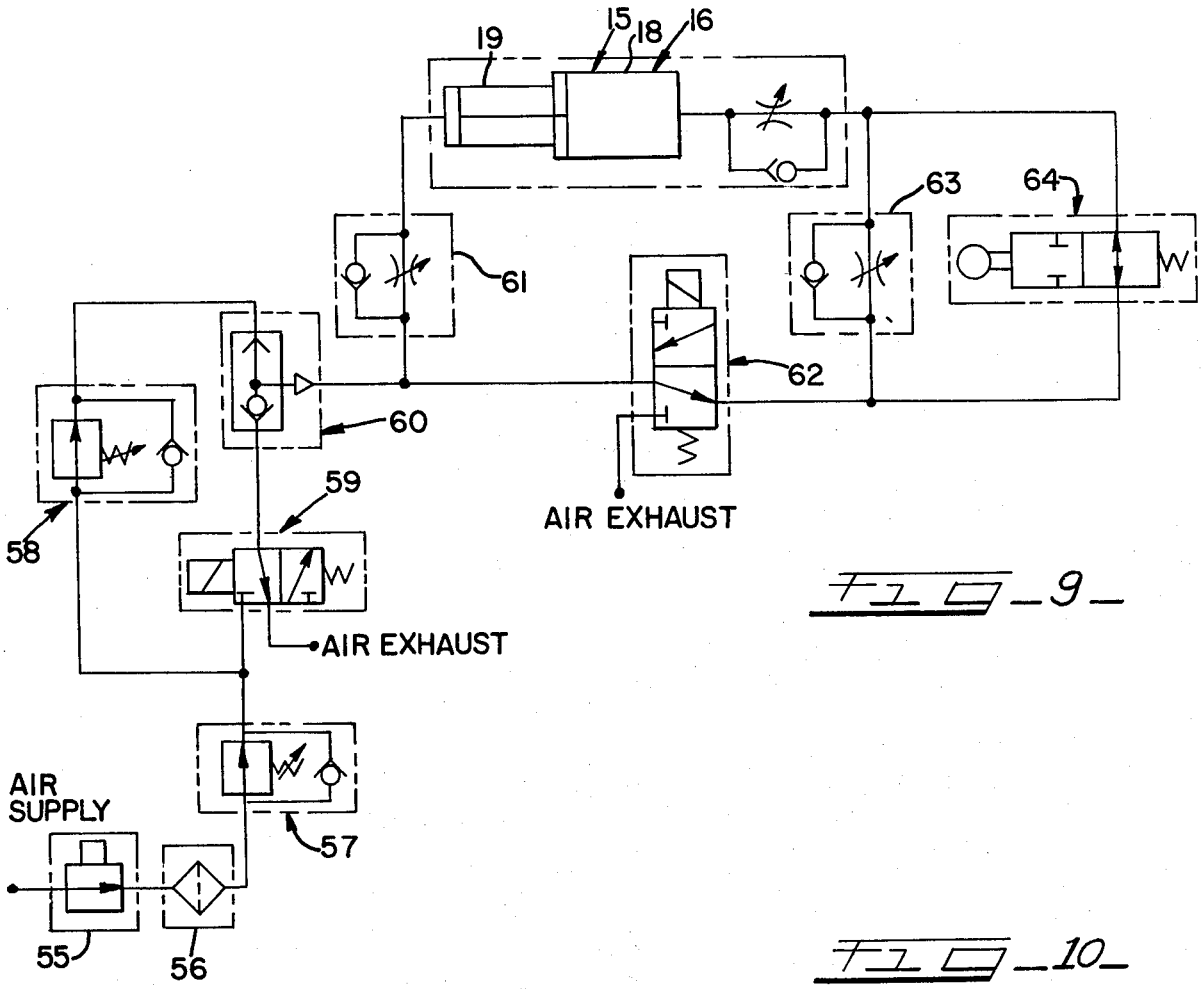
FIG. 9
FIG. 10
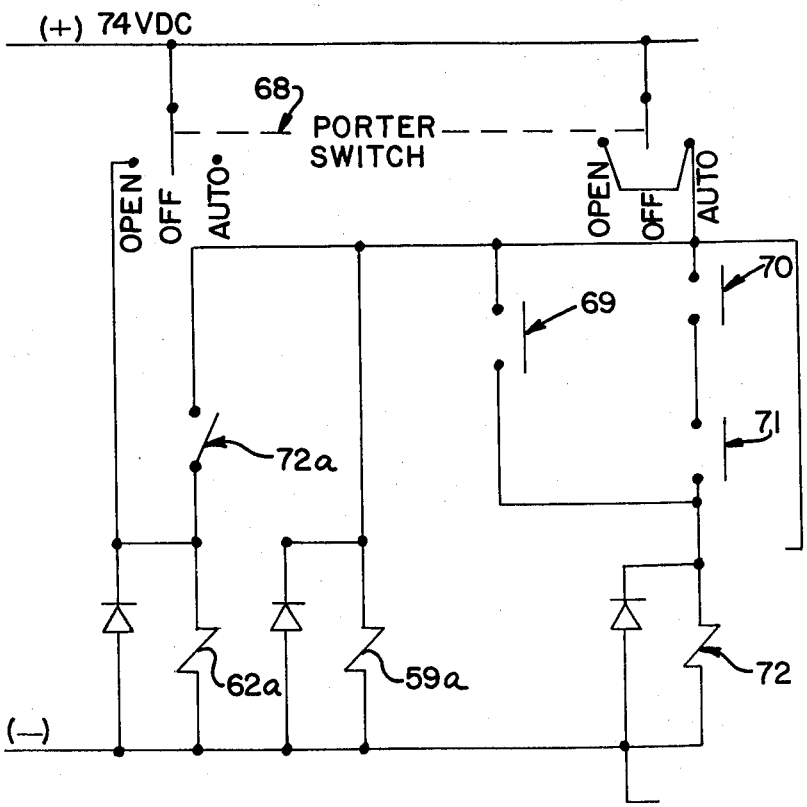

MODULATED OUTPUT FORCE DOOR OPERATOR

This invention relates in general to an apparatus for driving doors between open and closed positions in a vehicle or a building, and more particularly to a pneumatic door operator capable of producing a modulated output force and also capable of providing a pneumatic spring arrangement which allows manual operation.

The present invention is particularly concerned with the operation of doors on railroad passenger cars, and particularly sliding doors arranged between interconnected passenger cars to provide automatic door operation for passenger traffic between the cars. It is therefore important to safeguard passengers using such doors against injury, and it is also important to facilitate the manual operation of the doors in the event of electrical failure. Such door operators are preferably passenger actuated for opening and automatically actuated for closing. Further, such operators must have provisions for sensing an obstruction to prevent injury of a passenger that may be obstructing the closing of the door.

The door operator of the present invention utilizes a pneumatic differential engine and includes the usual feature of having an obstruction sensor which when actuated will recycle the door through an opening cycle. Door operators utilizing differential pneumatic engines are well known, as shown in U.S. Pat. Nos. 1,557,684 and 1,849,516. A door operator with an obstruction sensor is shown in U.S. Pat. No. 3,916,567. Door operators heretofore known of this type have been objectionable inasmuch as they have exhibited a closing buildup force of fifty percent from mid travel to door close position during the closing cycle. The present invention eliminates this buildup and provides a modulated force to the door during the closing cycle. Heretofore, door operators utilizing pneumatic door engines have been provided with non-adjustable mechanical springs for facilitating manual door operation in the event of electrical failure. The door operator of the present invention is capable of providing multiple force levels to the door in the closed position wherein a pneumatic spring arrangement is provided that allows for manual operation of the doors in the event of electrical failure when air is still available. An adjustable closing cushion is also provided with the operator of the present invention.

It is therefore an object of the present invention to provide a new and improved pneumatic door operator for driving doors between open and closed positions and particularly where the doors are utilized for handling passenger traffic.

A further object of this invention is in the provision of a modulated output force door operator utilizing a pneumatic differential engine together with an improved linkage arrangement for applying a modulated force to a door during the closing cycle for the door.

A further object of the invention is in the provision of a door operator especially useful for handling doors through which passenger traffic is provided and which includes an electro-pneumatic control circuit capable of providing a pneumatic spring arrangement in the event of electrical failure with air available to allow manual operation of the door and yet to retain the door in a closed position when not manually actuated.

Other objects, features and advantages of the invention will be apparent from the following detailed disclosure, taken in conjunction with the accompanying sheets of drawings, wherein like reference numerals refer to like parts, in which:

FIG. 4 is an enlarged side elevational view of a part of the door operator of the present invention and particularly illustrating the output linkage arrangement which produces the modulated output force to a door;

FIG. 5 is an end elevational view of the output linkage shown in FIG. 4;

FIG. 6 is a top plan view of the output linkage shown in FIG. 4;

FIG. 9 is a schematic diagram of the pneumatic circuit for the door operator of the invention and illustrating the state of the circuit when the door is in closed position; and FIG. 10 is an electrical schematic diagram of the circuit for the door operator of the invention and illustrating the state of the circuit when the door is in closed position and when the porter switch is in off position.

The door operator of the invention is especially useful for railway transit cars which transport passengers and which have passenger doors between connecting cars that are normally maintained closed and which are desired to be opened by passengers during movement between cars. Accordingly, the door operator of the invention may be actuated by a passenger to drive it throughout the opening cycle. Alternately, the door operator may be controlled by the porter to open the door and maintain it in open position or to maintain the door in closed position. When the operator is set for passenger operation, it is only necessary for a passenger to actuate a switch to cause the door to open after which the door operator goes through the door opening cycle. Since the door operator is one having a pneumatic differential engine, an electropneumatic control circuit controls the engine through opening and closing cycles. Once the door engine completes the opening cycle, it will automatically go through a closing cycle upon the lapse of a predetermined delay. In the event an obstruction is sensed at the door edge during the closing cycle, the operator will recycle through the opening cycle. In the event of electrical failure, the differential engine is conditioned with a lower pneumatic force level which permits manual opening of the door.

Figure 1:
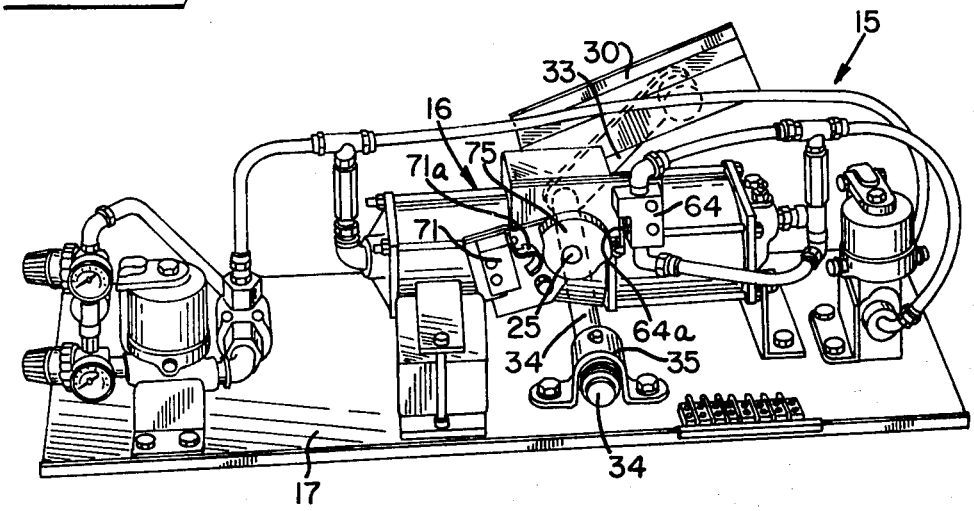
FIG. 1 is a perspective view of the door operator according to the present invention.

The door operator unit of the invention is illustrated in FIG. 1 and generally designated by the numeral 15 and which generally includes a pneumatic differential engine 16 mounted on a base plate 17. The engine is of the general type shown in the above-mentioned U.S. patents and includes a housing having interconnected large and small cylinders 18 and 19 receiving large and small pistons 20 and 21 respectively, wherein the pistons are interconnected by a rod 22 having a rack gear 23 in engagement with a pinion gear 24 mounted on an output shaft 25. The cylinders 18 and 19 and the respective pistons are characterized large and small for differentiation and the significance here is that they are of different sizes. The housing for the cylinders is supported on suitable brackets 26 and 27 that are secured to the base plate 17.

Figure 2:
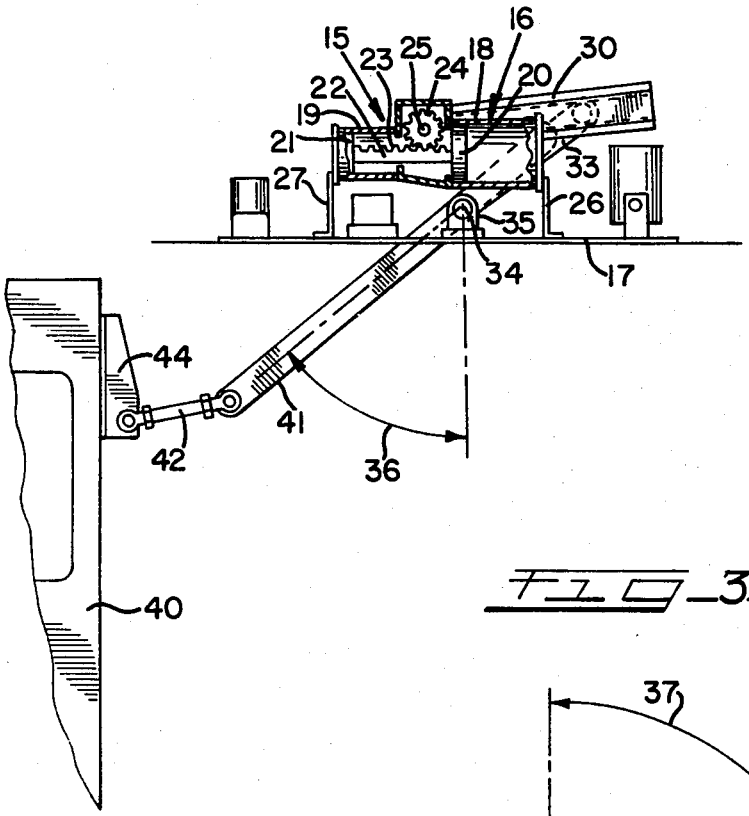
FIG. 2 is a somewhat diagrammatic view of the door operator of the present invention mounted overhead and interconnected with a door.
Figure 3:
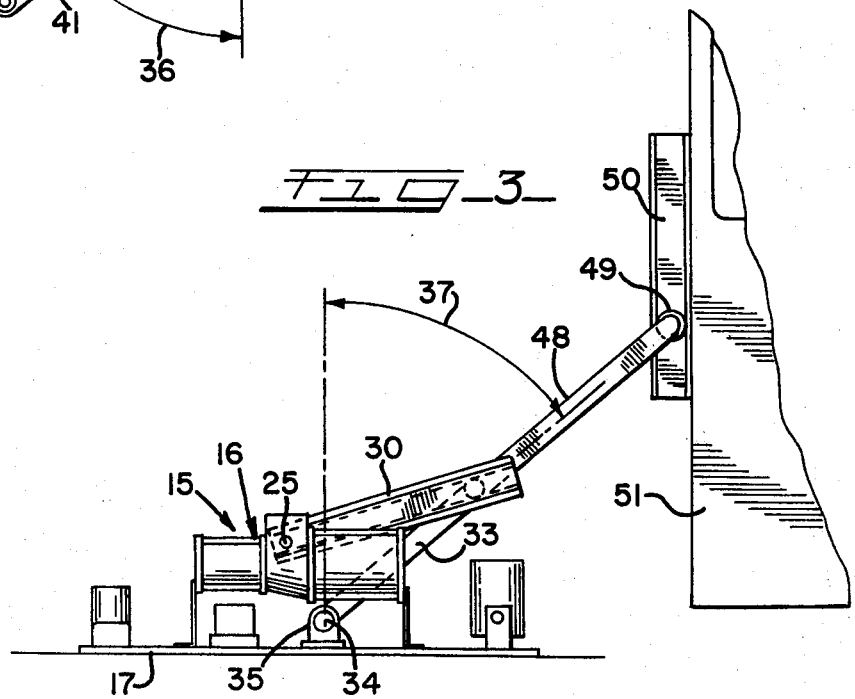
FIG. 3 is a somewhat diagrammatic view of the door operator of the present invention mounted on a floor and drivingly connected to a door.

A slide bar 30 is connected at one end to the output shaft 25 and defines a track 31 for receiving a roller 32 mounted on the end of a multiplying lever 33. The other end of the multiplying lever is secured to a shaft 34 rotatably mounted in bearings 35 secured to the base plate 17. The axis of the shaft 34 is parallel to the axis of the engine output shaft 25. Further, the shaft 34 is located beneath the shaft 25. During the opening cycle of the engine 16, the output shaft 25 rotates through an arc to drive the slide bar 30 upward and to the left, as shown in FIGS. 2 and 3. All of the necessary supporting components for controlling the operation of the engine 16 are preferably supported on the base plate 17.

The modulated output force generated by the engine 16, slide bar 30 and multiplying lever 33 and applied to the door is accomplished by the interrelationship between the rotation of the output shaft 25 and slide bar 30, the lengths of the slide bar and the multiplying lever and the relative rotations of the output shaft and the multiplying lever. This relationship is such that rotation of the slide bar about 180 degrees during the opening and closing cycles will produce about an 80 degree rotation of the multiplying lever. As viewed in FIGS. 2 and 3, rotation of the slide bar about 90 degrees effects about a 40 degree rotation of the multiplying lever to the mid travel point of the opening or closing cycle as generally represented by the angle 36 in FIG. 2 and the angle 37 in FIG. 3. The angles represented are equivalent to movement of the door to mid travel point during the opening cycle, and it can be appreciated that further rotation of the slide bar another nearly 90 degrees will further effect rotation of the multiplying lever about another 40 degrees. Accordingly, a modulated force output is generated by the engine through the slide bar and the multiplying lever arrangement as represented by the graphical illustrations of FIGS. 7 and 8.

An illustration of how the operator 15 can be mounted overhead at the ceiling is shown in FIG. 2, while an illustration of how it can be mounted on the floor is shown in FIG. 3. With respect to both of these embodiments, the multiplying lever 33 will move through an arc of substantially the same extent during the opening and closing cycles of the engine.

The embodiment of FIG. 2 where the operator is mounted at the ceiling is interconnected with a door 40 through pivotally interconnected links or arms 41 and 42. The arm 41 which is an extension of the multiplying lever 33 is connected to the lever 33 by means of a pair of connecting bolts or fasteners 43. The arm 41 is therefore connected at one end to the multiplying lever 33 and at the other end of a connecting link or arm 42, the latter of which is in turn pivotally connected to a bracket 44 secured to one edge of the door 40. Accordingly, opening and closing forces produced by the differential engine 16 are transmitted through the slide bar 30 and multiplying lever 33 to the arms 41 and 42 and finally the door 40.

Where the door operator is mounted on the floor, as shown in FIG. 3, the engine is connected through the slide bar and multiplying lever to the door by means of a roller arm 48 having a roller 49 at the free end engageable in a track 50 secured to the edge of the door 51. During operation of either of the embodiments of FIGS. 2 and 3, the slide bar 30 traverses through a greater angle than the driven multiplying lever 33 or the extension arms 41 and 48. By virtue of the fasteners 43 mounted on the multiplying lever 33, the installation of a door operator of the invention and the connections between the multiplying lever and the door are relatively easy and can be accomplished quickly. Further, the door operator is universal to the extent that it can also then be used either as a unit mounted at the ceiling or a unit mounted at the floor and for a left-hand or a right-hand installation.

Figure 7:
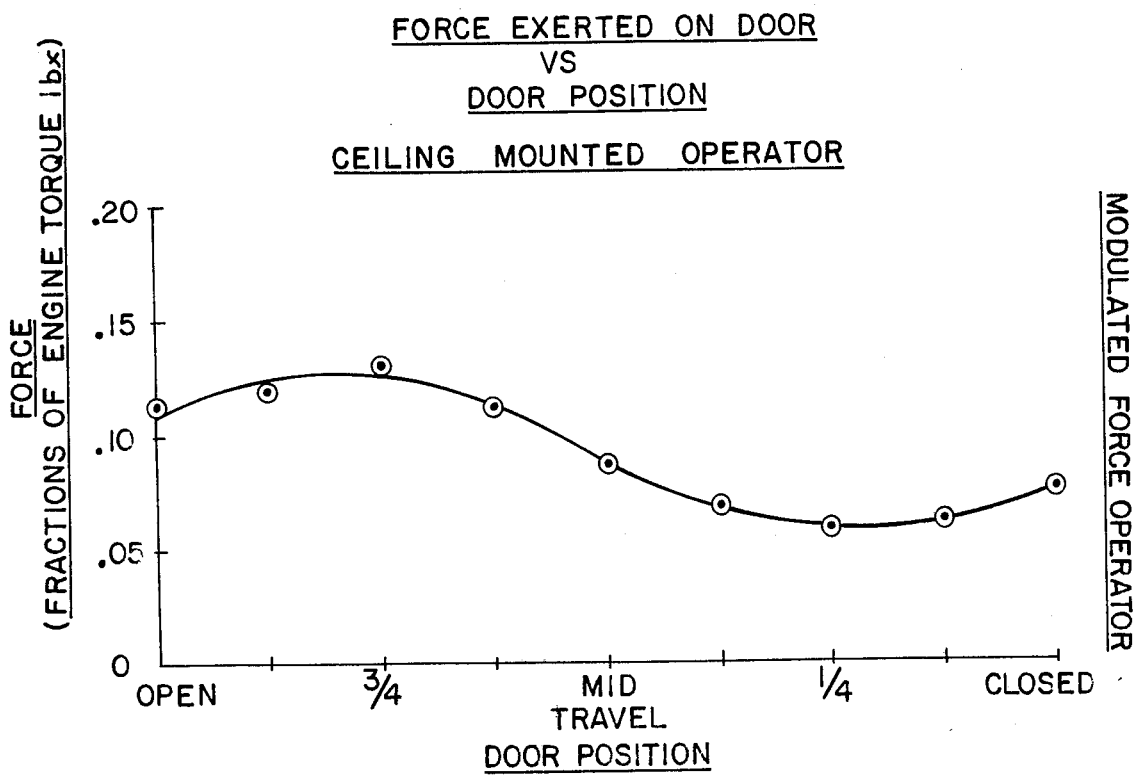
FIG. 7 is a force diagram of the door operator of the invention and particularly the embodiment of FIG. 2.
Figure 8:
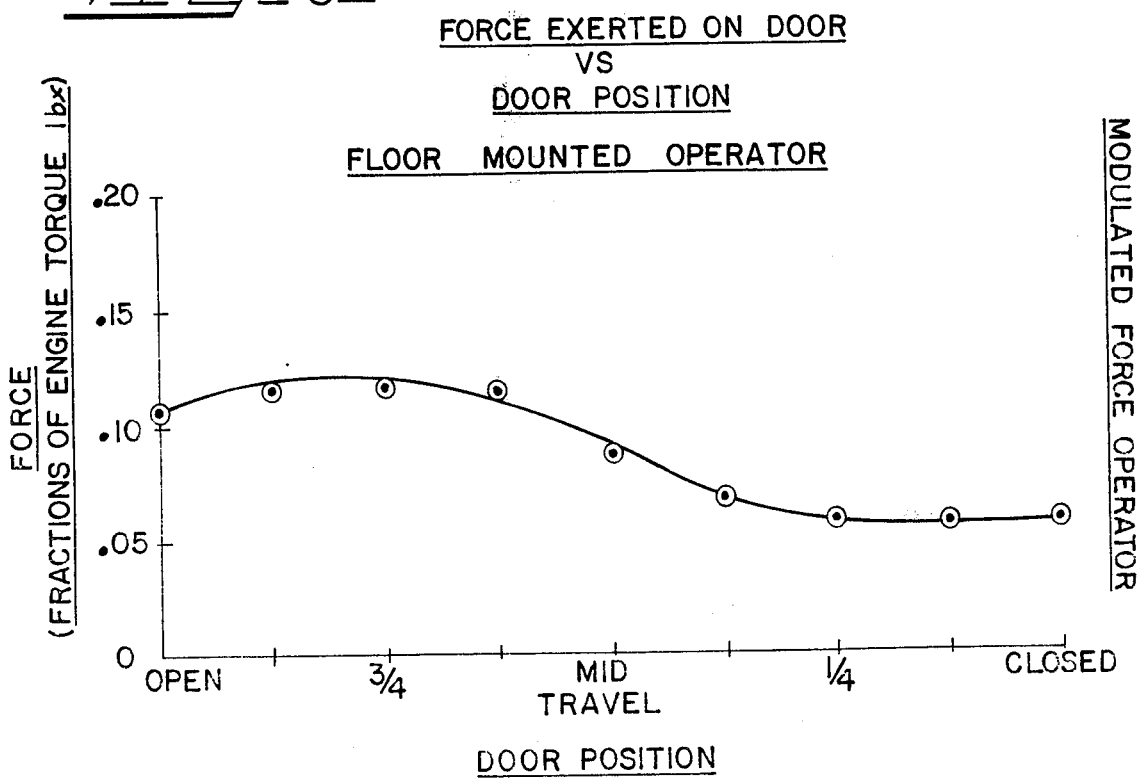
FIG. 8 is a force diagram of the door operator of the invention and particularly the embodiment of FIG. 3.

The modulated force applied to the door by the door operation of the invention is graphically illustrated in FIGS. 7 and 8. The illustration of FIG. 7 relates to a ceiling mounted operator such as shown in FIG. 2, while the illustration of FIG. 8 relates to a floor mounted operator, as shown in FIG. 3. It can be appreciated from these graphical illustrations that the modulated force produced by the operator is relatively constant throughout the travel of the door during the closing cycle and that the force drops off slightly between the mid point of the closing cycle and the fully closed position.

The pneumatic circuit for the differential engine 16 is illustrated in FIG. 9 and generally includes an air supply to an air cock 55, an air strainer 56, an adjustable high pressure regulator 57, an adjustable low pressure regulator 58, a three-way normally closed magnet valve 59, a shuttle valve 60, an adjustable door closing metering valve or flow control valve 61, a door open three-way normally open magnet valve 62, an adjustable door opening cushioning metering valve or flow control valve 63, and a cam operated air valve 64. The components of the circuit as illustrated are in the condition when the door is in closed position.

The electrical control circuit for the door operator of the invention is shown in FIG. 10 and includes generally a porter switch 68 operable between off, open and automatic positions, a passenger switch 69 of the momentary push type for effecting the opening cycle, a sensitive edge switch 70 which may be mounted along the edge of the door and which would sense an obstruction and which would function, when actuated, to recycle the door operator through the opening cycle, a cam operated limit switch 71 which opens and prevents operation of the sensitive edge switch when the door is in closed position, and a time delay relay 72 which functions to maintain the door in open position through a predetermined period of time and thereafter to condition the circuit for the closing cycle. The time delay relay 72 includes contacts **72*a*. Further, the magnet portion of the threeway magnet valves 59 and 62 are illustrated as 59*a* and 62*a*. It will be understood that the limit switch 71** opens just ahead of the closed position or just prior to the door reaching closed position. Likewise, it will close during the opening cycle just after the door leaves the closed position to render effective the sensitive edge switch circuit.

The operation of the door operator electropneumatic control circuit during the opening and closing cycles further depends upon the mechanical actuation of the cam operated air switch 64 and the cam operated limit switch 71. As seen in FIG. 1, a cam 75 is mounted on the output shaft 25 of the engine 16 and which engages and operates the actuating arm **64*a* of the cam operated switch 64 and the actuating arm 71*a* of the limit switch 71. As illustrated in FIG. 1, the cam is positioned with the door in closed position and which conditions the cam operated air switch 64, as shown in FIG. 9, and the cam operated limit switch 71, as shown in FIG. 10. Shortly after the engine commences the opening cycle, the cam operated air switch 64 is closed and the cam operated limit switch 71** is closed.

With the porter switch 68 in the automatic position and upon actuation of the passenger switch 69 by a passenger, closing of switch 69 causes energization of the time delay relay 72 to close the content 72*a* and thereby energize the door open magnet valve 62. The time delay for the time delay relay 72 starts when the relay is de-energized upon opening of the passenger switch 69 and is set to hold the contact 72*a* in closed position and the magnet valve 62 to exhaust for about 15 seconds or a suitable period of time so that the passenger can complete movement through the doorway. While the door open magnet valve 62 is energized, the air from the large cylinder 18 is exhausted. Initially, the cam operated valve 64 is open to allow an initial unregulated flow of air to exhaust to begin opening of the door. Following this quick burst of air, the valve 64 closes by operation of cam 75, whereby the exhaust air from the large cylinder must then pass through the parallel circuit having the flow control valve 63 which cushions the door opening cycle.

When the door reaches the fully open position, and at the expiration of the time delay set up by the time delay relay 72, the time delay relay drops out and de-energizes the door open magnet valve 62 to once again connect the large cylinder to the high pressure regulated source and cause closing of the door. Both the air directed to the large cylinder and the air then exhausted from the small cylinder 19 is regulated to provide a door closing cushion. The door closing cushioning valve 61 regulates the exhausting of the air from the small cylinder 19.

During the closing cycle, it will be appreciated the limit switch 71 will be closed, thereby conditioning the sensitive edge circuit so that upon actuation the sensitive edge switch 70 will cause energization of the time delay relay 72 and consequent energization of the door opening magnet valve 62 to cause the door engine to go through an opening cycle. Thus, an obstruction at the edge of the door during the closing cycle will cause actuation of the sensitive edge switch 70 and a recycling of the door open cycle.

By actuation of the porter switch 68 to the open position, the time delay relay contacts 72 are bypassed and the door open magnet valve 62 is energized to cause the operator to effect the opening cycle and maintain the door in an open position. Thus, the doors will then remain in the open position until the porter switch is actuated to either the off or automatic positions.

It will be appreciated that when the porter switch is in either the open or automatic position, the high pressure magnet valve 59 is energized to connect the high pressure from the high pressure regulator 57 to the shuttle valve 60. In the event the electrical power fails at this time, the high pressure magnet valve 59 will de-energize, thereby shutting off the high pressure regulator to the shut-off valve and exhausting the system of the high pressure level. Air from the high pressure valve is then channeled through the parallel circuit which includes the low pressure regulator 58 which delivers the low pressure through the shuttle valve to the system. This low pressure allows the doors to be opened and closed manually. The air pressure at this point is sufficient so that it will maintain the doors in a closed position when desired. Actually, the door once opened manually will automatically close slowly due to the differential force between the large and small cylinders of the differential engine. This effectively defines a pneumatic spring effect to the door and eliminates the need to provide any mechanical spring for maintaining the door in closed position.

It will be understood that modifications and variations may be effected without departing from the scope of the novel concepts of the present invention, but it is understood that this application is to be limited only by the scope of the appended claims.

The invention is hereby claimed as follows:

1. In a door operator for driving a door between open and closed positions, which operator includes a pneumatic differential engine having an output shaft, the improvement in means connected to the output shaft to modulate the driving force applied to the door which comprises, a slide bar directly secured to and oscillatable with the output shaft, and a multiplying lever pivotally mounted at one end on an axis parallel to the output shaft axis and having a roller at the other end engaging in said slide, said lever being adapted to be connected to said door.

2. The improvement defined in claim 1, wherein said pivot axis of said multiplying lever is spaced below the output shaft axis.

3. The improvement defined in claim 2, wherein the length of the lever and the length of the slide bar is such that rotation of the slide bar about 180 degrees during the door opening and door closing cycles causes the lever to rotate about 80 degrees.

4. The improvement defined in claim 1, which further includes means on the lever for connecting to linkage mounted on the door.

5. In a system for driving a door between open and closed positions, which system includes a differential pneumatic door engine, an air supply for driving the engine, said engine having an output shaft and large and small cylinders driving said shaft, and means drivingly connecting the output shaft to the door, the improvement being in control means for the engine which comprises means continuously connecting the air supply directly to the small cylinder, a three-way door open magnet valve connected between the air supply and the large cylinder interconnecting the air supply to the large cylinder when de-energized to cause a door closing cycle and to exhaust when energized to cause a door opening cycle, a door closing metering valve between the air supply and the small cylinder for cushioning the door closing cycle, a door opening cushioning valve between the three-way magnet valve and the large cylinder, a cam operated valve connected in parallel with the door opening cushioning valve in the open position when the engine is in the door closed position and in the closed position shortly after the commencement of the opening cycle, and cam means on the output shaft for controlling said cam operated valve.

6. The improvement as defined in claim 5, wherein said door closing metering valve and said door opening cushioning valve are adjustable.

7. The improvement as defined in claim 5, which further includes means between the air supply and said engine for reducing the pressure level to the engine so that the engine produces a pneumatic spring effect to permit the door to be manually opened.

8. The improvement as defined in claim 7, wherein said pressure level reducing means includes a shuttle valve, a high pressure regulator, a three-way pressure magnet valve between the high pressure regulator and the shuttle valve, a low pressure regulator between the shuttle valve and the outlet of the high pressure valve and the inlet of the pressure magnet valve, whereby the pressure magnet valve when energized connects the high pressure regulator to the shuttle valve and when de-energized exhausts the high pressure level of the system and disconnects the high pressure valve from the shuttle valve.

9. The improvement as defined in claim 8, wherein the shuttle valve connects the high pressure regulator to the engine when the pressure magnet valve is energized and connects the low pressure regulator to the engine when the pressure magnet valve is deenergized.

10. The improvement as defined in claim 9, which further includes an obstruction sensing circuit responsive to an obstruction at the door edge to recycle the opening cycle upon sensing a door obstruction.

11. In a door operator for driving a door between open and closed positions, which operator includes means driving an output shaft, the improvement in means connected to the output shaft to modulate the driving force applied to the door and apply a substantially constant force to the door during movement thereof between open and closed position which comprises, a slide bar directly secured to and oscillatable with the output shaft, and a multiplying lever pivotally mounted at one end on an axis parallel to the output shaft axis and having a roller at the other end engaging in said slide, said lever being adapted to be connected to said door.

12. The improvement defined in claim 11, wherein said pivot axis of said multiplying lever is spaced below the output shaft axis.

13. The improvement defined in claim 12, wherein the length of the lever and the length of the slide bar is such that rotation of the slide bar about 180 degrees during the door opening and door closing cycles causes the lever to rotate about 80 degrees.

* * * * *